US006821168B1

(12) United States Patent
Fisher et al.

(10) Patent No.: US 6,821,168 B1
(45) Date of Patent: Nov. 23, 2004

(54) POWER STEERING SYSTEM FOR A MARINE VESSEL

(75) Inventors: Brian L. Fisher, Oakfield, WI (US); Robert Stuber, Rosendale, WI (US); Jeremy L. Alby, Oshkosh, WI (US); Allen F. Swan, Mayville, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/727,130

(22) Filed: Dec. 3, 2003

(51) Int. Cl.[7] ..... B63H 5/12
(52) U.S. Cl. ..... 440/61 R; 114/150
(58) Field of Search ..... 440/53, 58, 60, 440/61 R; 114/144 R, 150

(56) References Cited

U.S. PATENT DOCUMENTS 5,213,527 A * 5/1993 Fetchko ..... 440/61 R
5,330,375 A * 7/1994 Tsujii et al. ..... 440/61 R
5,601,463 A * 2/1997 Kobelt ..... 440/61 R
5,658,177 A * 8/1997 Wagner ..... 440/61 R
6,146,220 A 11/2000 Alby et al. ..... 440/53
6,183,321 B1 2/2001 Alby et al. ..... 440/61
6,276,977 B1 8/2001 Treinen et al. ..... 440/61
6,402,577 B1 6/2002 Treinen et al. ..... 440/61
6,454,620 B1 * 9/2002 Theisen et al. ..... 440/61 R

* cited by examiner

*Primary Examiner*—S. Joseph Morano
*Assistant Examiner*—Lars Olson
(74) *Attorney, Agent, or Firm*—William D. Lanyi

(57) ABSTRACT

An outboard motor is provided with an internally contained cylinder and moveable piston. The piston is caused to move by changes in differential pressure between first and second cavities within the cylinder. By adding a hydraulic pump and a steering valve, the hydraulic steering system described in U.S. Pat. No. 6,402,577 is converted to a power hydraulic steering system by adding a hydraulic pump and a steering valve to a manual hydraulic steering system.

10 Claims, 1 Drawing Sheet

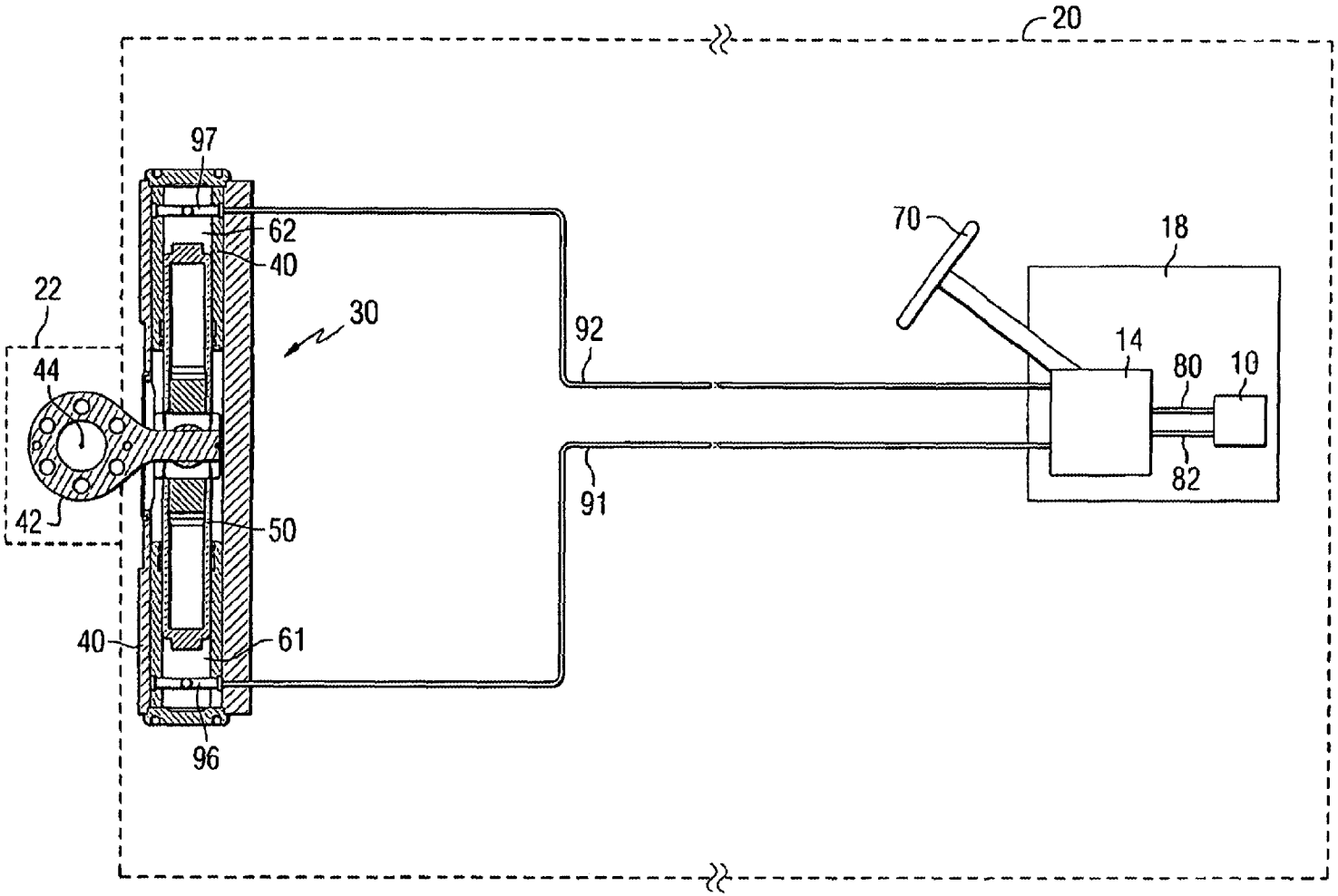
20
18
10
80
82
14
70
92
91
30
62
40
50
61
97
96
40
22
44
42

POWER STEERING SYSTEM FOR A MARINE VESSEL

BACKGROUND OF THE INVENTION

1. Field of the Invention

The present invention generally relates to a power steering system for a marine vessel and, more particularly, to a power steering system that incorporates an integrated steering cylinder and piston that is formed as an integral part of an outboard motor support structure.

2. Description of the Prior Art

It is a known procedure in the marine industry, particularly with outboard motors, to provide either manual hydraulic steering systems or power hydraulic steering systems in order to assist the operator of a marine vessel in causing the marine propulsion system to rotate about its steering axis. Most of the systems are provided as "aftermarket" products that are added to the marine propulsion system after it is initially purchased. Some of these systems are provided by boat builders who combine a marine propulsion system purchased from one manufacturer with a hydraulic steering system or power steering system purchased from another supplier. In most cases, a steering cylinder is attached to the outboard motor to provide the necessary forces for causing the outboard motor to rotate about its steering axis in response to movement of a steering wheel by the operator of the marine vessel.

U.S. Pat. No. 6,402,577, which issued to Treinen et al. on Jun. 11, 2002, discloses an integrated hydraulic steering system for a marine propulsion unit. The steering system is provided in which a steering actuator is an integral portion of the support structure of the marine propulsion system. A steering arm is contained completely within the support structure of the marine propulsion system and is disposed about its steering axis. An extension of the steering arm extends into a sliding joint which has a linear component and a rotational component which allows the extension of the steering arm to move relative to a moveable second portion of the steering actuator. The moveable second portion of the steering actuator moves linearly within a cylinder cavity formed in a first portion of the steering actuator.

U.S. Pat. No. 6,276,977, which issued to Treinen et al. on Aug. 21, 2001, discloses an integrated hydraulic steering actuator. The actuator is provided for an outboard motor system in which the cylinder and piston of the actuator are disposed within a cylindrical cavity inside a cylindrical portion of a swivel bracket. The piston within the cylinder of the actuator is attached to at least one rod that extends through clearance holes of a clamp bracket and is connectable to a steering arm of an outboard motor. The one or more rods attached to the piston are aligned coaxially with an axis of rotation about which the swivel bracket rotates when the outboard motor is trimmed. As a result, no relative movement occurs between the outboard motor, the rod attached to the piston of the actuator, and the swivel bracket during rotation of the outboard motor about the axis of rotation.

U.S. Pat. No. 6,146,220, which issued to Alby et al. on Nov. 14, 2000, discloses a pedestal mount for an outboard motor. The outboard motor is mounted to a transom of a boat with a pedestal that is attached either directly to the transom or to an intermediate place that is, in turn, attached to the transom. A motor support platform is attached to the outboard motor, and a steering mechanism is attached to both pedestal and the motor support platform. The tilting mechanism is attached to the motor support platform and to the outboard motor. The outboard motor is rotatable about a tilting axis relative to both the pedestal and the motor support platform. The tilting mechanism is rotatable relative to the pedestal and about a steering axis. The steering axis is generally vertical and stationary relative to the pedestal and is unaffected by the tilting of the outboard motor. The tilting mechanism is rotatable relative to the pedestal and about the steering axis with the outboard motor.

U.S. Pat. 6,183,321, which issued to Alby et al. on Feb. 6, 2001, discloses an outboard motor with a hydraulic pump and an electric motor located within a steering mechanism. The outboard motor comprises a pedestal that is attached to a transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

The patents described above are hereby expressly incorporated by reference in the description of the present invention.

Since the use of power steering systems in conjunction with outboard motors typically requires the addition of cylinders and pistons to exert the necessary forces to cause the outboard motor to rotate about its steering axis, it would be significantly beneficial if a power steering system could be provided for use in conjunction with a steering cylinder and piston that is incorporated as an internal component of the outboard motor support structure.

SUMMARY OF THE INVENTION

A marine propulsion system, made in accordance with the preferred embodiment of the present invention, comprises a support structure attachable to the marine propulsion system and to a marine vessel. The marine propulsion system is rotatable about a generally vertical steering axis and a generally horizontal tilting axis. A steering arm is attachable to the marine propulsion system and is rotatable about the steering axis. A steering actuator has a first portion attachable to the support structure and a second portion attached in force transmitting relation with the steering arm. The steering arm extends into the second portion. The second portion is moveable within the first portion. The first portion remains stationary with respect to the support structure during rotation of the marine propulsion system about either its steering axis or its tilting axis. The steering actuator is a hydraulic actuator. The first portion of the steering actuator comprises a hydraulic cylinder and a second portion of the steering actuator is a moveable piston within the first portion of the steering actuator in response to changes in hydraulic pressure between a first cavity and a second cavity of the hydraulic cylinder. A hydraulic pump is provided and has a pressurized outlet and a return inlet. A valve, which is connected in fluid communication between the hydraulic pump and the hydraulic cylinder, is responsive to movement of a steering device to control the flow of pressurized fluid from the hydraulic pump to the hydraulic cylinder and to control the flow of return fluid from the hydraulic cylinder to the hydraulic pump.

The steering device is a steering wheel of a marine vessel in a particularly preferred embodiment of the present invention. The first cavity of the hydraulic cylinder is disposed at a first side of the moveable piston and the second cavity of the hydraulic cylinder is disposed at a second side of the moveable piston. The moveable piston is disposed between the first and second cavities. The valve comprises a first conduit connected in fluid communication with the first cavity and the second conduit connected in fluid communication with the second cavity.

The support structure, steering arm, and steering actuator of the present invention is preferably made in accordance with the components described in U.S. Pat. No. 6,402,577. The interaction of the steering actuator, the moveable piston within the hydraulic cylinder, and the steering axis of the outboard motor are described in detail in U.S. Pat. No. 6,402,577 and will not be described herein. From a reading of U.S. Pat. No. 6,402,577, it can be clearly understood that the reciprocal movement of the moveable piston within the hydraulic cylinder causes the steering arm to rotate about the steering axis and, as a result, the outboard motor is rotated about the steering axis. The moveable piston slides axially back and forth within the cylinder and the entire mechanical structure of the steering actuator and the steering arm are conveniently contained within the support structure of the outboard motor.

BRIEF DESCRIPTION OF THE DRAWINGS

The present invention will be more fully and completely understood from a reading of the description of the preferred embodiment in conjunction with the drawing, in which:

FIG. 1 is a schematic representation of the present invention.

DESCRIPTION OF THE PREFERRED EMBODIMENT

Throughout the description of the preferred embodiment of the present invention, like components will be identified by like reference numerals.

FIG. 1 is a schematic representation of the present invention. A hydraulic pump 10 is connected to a valve 14 which is located at the helm 18 of a marine vessel 20. At the rear portion of the marine vessel 20, an outboard motor 22 is represented schematically by a dashed box. The steering mechanism 30 is generally the same as the steering mechanism shown in FIGS. 7A and 7B of U.S. Pat. No. 6,402,577. The internal structure of the steering mechanism 30 is identical to that shown in U.S. Pat. No. 6,402,577 and, therefore, the specific structure will not be described herein except in terms of the portions of the structure that are directly relevant to the power steering system illustrated in FIG. 1. The cylinder 40 is rigidly supported by the support structure of the outboard motor 22, such as by the transom bracket used in accordance with the outboard motor. The steering arm 42 is attachable to the marine propulsion system and is rotatable about the steering axis 44. The steering actuator 30 comprises a generally stationary cylinder 40 and an actually moveable piston 50. The first cavity 61 and the second cavity 62 are contained within the cylinder 40 at opposite ends of the moveable piston 50. Differential pressure between the first and second cavities, 61 and 62, cause the moveable piston 50 to move axially within the cylinder 40. Movement of the moveable piston 50 causes the steering arm 42 to rotate about the steering axis 44, as described in detail in U.S. Pat. No. 6,402,577. In that patent, a manual hydraulic steering system causes changes in the differential pressure between the first and second cavities, 61 and 62. In order to improve that steering system so that higher steering loads could be compensated more easily by the movement to a steering wheel 70, a power hydraulic system is provided by the present invention.

The hydraulic pump 10 has a pressurized outlet 80 and a return inlet 82. Pressurized hydraulic fluid is continually provided by the pump 10 to the valve 14. When no steering effort is needed, the pressurized hydraulic fluid passes through the valve 14 and is returned through line 82 to the reservoir of the pump 10. This type of pump arrangement, with a pressurized line 80 and a return line 82, is generally known to those skilled in the art.

The valve 14 is connected in fluid communication with the hydraulic pump 10 and with the hydraulic cylinder 40. The valve 14 is responsive to movement of a steering device 70 to control the flow of pressurized fluid from the hydraulic pump 10 to the hydraulic cylinder 40 and to control the flow of return fluid from the hydraulic cylinder 40 to the hydraulic pump 10. In a manner that is generally known to those skilled in the art, the valve 14 allows selective flow of pressurized fluid to the side (i.e. the cavity, 61 or 62) of the piston 50 that will result in the rotation of the steering arm 42 in the desired direction. As an example, to execute a right turn, pressurized fluid will be directed by the valve 14 through a first conduit 91 into the first cavity 61 of the steering actuator. This causes the moveable piston 50 to move upwardly in FIG. 1 and, as a result, cause the steering arm 42 to rotate in a counter-clockwise direction about the steering axis 44. This, in turn, causes hydraulic fluid to move out of the second cavity 62 and then return to the valve 14 through the second conduit 92. Hydraulic fluid passing is through either the first or second conduits, 91 and 92, flows directly through the valve 14 as it flows between the pump 10 and the first and second cavities, 61 and 62, of the cylinder 40. Through the addition of a pump 10 and valve 14, the steering mechanism described in U.S. Pat. No. 6,402,577, can be converted from a hydraulic steering system to a power steering system.

With continued reference to FIG. 1, the hydraulic fluid in the first and second cavities, 61 and 62, passes from the cylinder 40 to the valve 14 through conduits 96 and 97, respectively, which provide fluid communication between the first and second conduits, 91 and 92, and the first and second cavities, 61 and 62.

Although the present invention has been described in particular detail and illustrated to show a preferred embodiment, it should be understood that alternative embodiments are also within its scope. It should also be understood that the pump 10 is a hydraulic pump, provided with a reservoir of hydraulic fluid, that is available in commercial quantities and is well known to those skilled in the art of hydraulic equipment. It should also be understood that the valve 14 is available in commercial quantities and various alternative valves can be used in conjunction with the steering mechanism 70 to direct the flow of hydraulic fluid between the pump 10 and the steering mechanism 30.

We claim:

1. A marine propulsion system, comprising, a support structure attachable to said marine propulsion system and to a marine vessel, said marine propulsion system being rotatable about a generally vertical steering axis and a generally horizontal tilting axis;

a steering arm attachable to said marine propulsion system, said steering arm being rotatable about said steering axis;

a steering actuator having a first portion attached to said support structure and a second portion attached in force transmitting relation with said steering arm, said steering arm extending into said second portion, said second portion being movable within said first portion, said first portion remaining stationary with respect to said support structure during rotation of said marine propulsion system about either said steering axis or said tilting axis said steering actuator being a hydraulic actuator, said first portion of said steering actuator comprising a hydraulic cylinder and said second portion of said steering actuator being a movable piston which is movable within said first portion of said steering actuator in response to changes in hydraulic pressure between a first cavity and a second cavity of said hydraulic cylinder;

a hydraulic pump having a pressurized outlet and a return inlet; and a valve, connected in fluid communication between said hydraulic pump and said hydraulic cylinder, said valve being responsive to movement of a steering device to control the flow of pressurized fluid from said hydraulic pump to said hydraulic cylinder and to control the flow of return fluid from said hydraulic cylinder to said hydraulic pump.

2. The marine propulsion system of claim 1, wherein:

said steering device is a steering wheel of a marine vessel.

3. The marine propulsion system of claim 1, wherein:

said first cavity of said hydraulic cylinder is disposed at a first side of said movable piston and said second cavity of said hydraulic cylinder is disposed at a second side of said movable piston, said movable piston being disposed between said first and second cavities.

4. The marine propulsion system of claim 1, wherein:

said valve comprises a first conduit connected in fluid communication with said first cavity and a second conduit connected in fluid communication with said second cavity.

5. A marine propulsion system, comprising:

a support structure attachable to said marine propulsion system and to a marine vessel, said marine propulsion system being rotatable about a generally vertical steering axis and a generally horizontal tilting axis;

a steering arm attachable to said marine propulsion system, said steering arm being rotatable about said steering axis;

a steering actuator having a first portion attached to said support structure and a second portion attached in force transmitting relation with said steering arm, said steering arm extending into said second portion, said second portion being movable within said first portion, said first portion remaining stationary with respect to said support structure during rotation of said marine propulsion system about either said steering axis or said tilting axis said steering actuator being a hydraulic actuator, said first portion of said steering actuator comprising a hydraulic cylinder and said second portion of said steering actuator being a movable piston which is movable within said first portion of said steering actuator in response to changes in hydraulic pressure between a first cavity and a second cavity of said hydraulic cylinder;

a hydraulic pump having a pressurized outlet and a return inlet; and a valve, connected in fluid communication between said hydraulic pump and said hydraulic cylinder, said valve being responsive to movement of a steering device to control the flow of pressurized fluid from said hydraulic pump to said hydraulic cylinder and to control the flow of return fluid from said hydraulic cylinder to said hydraulic pump, said valve comprising a first conduit connected in fluid communication with said first cavity and a second conduit connected in fluid communication with said second cavity.

6. The marine propulsion system of claim 5, wherein:

said steering device is a steering wheel of a marine vessel.

7. The marine propulsion system of claim 5, wherein:

said first cavity of said hydraulic cylinder is disposed at a first side of said movable piston and said second cavity of said hydraulic cylinder is disposed at a second side of said movable piston, said movable piston being disposed between said first and second cavities.

8. A marine propulsion system, comprising:

a support structure attachable to said marine propulsion system and to a marine vessel, said marine propulsion system being rotatable about a generally vertical steering axis and a generally horizontal tilting axis;

a steering arm attachable to said marine propulsion system, said steering arm being rotatable about said steering axis;

a steering actuator having a first portion attached to said support structure and a second portion attached in force transmitting relation with said steering arm, said steering arm extending into said second portion, said second portion being movable within said first portion, said first portion remaining stationary with respect to said support structure during rotation of said marine propulsion system about either said steering axis or said tilting axis said steering actuator being a hydraulic actuator, said first portion of said steering actuator comprising a hydraulic cylinder and said second portion of said steering actuator being a movable piston which is movable within said first portion of said steering actuator in response to changes in hydraulic pressure between a first cavity and a second cavity of said hydraulic cylinder, said first cavity of said hydraulic cylinder being disposed at a first side of said movable piston and said second cavity of said hydraulic cylinder being disposed at a second side of said movable piston;

a hydraulic pump having a pressurized outlet and a return inlet; and a valve, connected in fluid communication between said hydraulic pump and said hydraulic cylinder, said valve being responsive to movement of a steering device to control the flow of pressurized fluid from said hydraulic pump to said hydraulic cylinder and to control the flow of return fluid from said hydraulic cylinder to said hydraulic pump, said valve comprising a first conduit connected in fluid communication with said first cavity and a second conduit connected in fluid communication with said second cavity.

9. The marine propulsion system of claim 8, wherein:

said steering device is a steering wheel of a marine vessel.

10. The marine propulsion system of claim 9, wherein:

said movable piston is disposed between said first and second cavities.

* * * * *